US006329908B1

(12) United States Patent
Frecska

(10) Patent No.: US 6,329,908 B1
(45) Date of Patent: Dec. 11, 2001

(54) ADDRESSABLE SPEAKER SYSTEM

(75) Inventor: Sandor A. Frecska, Lancaster, PA (US)

(73) Assignee: Armstrong World Industries, Inc., Lancaster, PA (US)

( * ) Notice: Subject to any disclaimer, the term of this patent is extended or adjusted under 35 U.S.C. 154(b) by 0 days.

(21) Appl. No.: 09/603,297

(22) Filed: Jun. 23, 2000

(51) Int. Cl.[7] ..... G08B 3/10

(52) U.S. Cl. ..... 340/384.7; 340/825.2; 340/825.49; 340/825.52; 381/77; 381/80; 381/81; 381/82; 381/85

(58) Field of Search ..... 340/384.7, 825.2, 340/825.21, 825.22, 825.24, 825.25, 825.49, 825.44, 825.52; 381/77, 80, 81, 82, 85

(56) References Cited

U.S. PATENT DOCUMENTS

| | | | | |
|---|---|---|---|---|
| D. 415,764 | | 10/1999 | Azima et al. | D14/214 |
| D. 416,907 | | 11/1999 | Azima et al. | D14/214 |
| D. 420,005 | | 2/2000 | Azima et al. | D14/214 |
| 3,325,954 | | 6/1967 | Olson | 52/303 |
| 3,980,827 | | 9/1976 | Sepmeyer et al. | 179/1 |
| 3,985,957 | | 10/1976 | Torn | 179/1.5 |
| 4,013,846 | | 3/1977 | Krawczak et al. | 179/115.5 |
| 4,059,726 | | 11/1977 | Watters et al. | 179/1.5 |
| 4,098,370 | | 7/1978 | McGregor et al. | 181/150 |
| 4,319,088 | | 3/1982 | Orfield | 179/1.5 |
| 4,330,691 | | 5/1982 | Gordon | 179/146 |
| 4,385,210 | | 5/1983 | Marquiss | 179/114 |
| 4,476,572 | | 10/1984 | Horrall et al. | 381/73 |
| 4,506,117 | | 3/1985 | Fresard | 179/114 |
| 4,862,159 | * | 8/1989 | Marusa et al. | 340/825.24 |
| 4,914,706 | | 4/1990 | Krause | 381/73.1 |
| 5,033,247 | | 7/1991 | Clunn | 52/484 |
| 5,131,048 | * | 7/1992 | Farenelli et al. | 381/81 |
| 5,363,434 | | 11/1994 | Farinelli et al. | 379/170 |
| 5,406,634 | * | 4/1995 | Anderson et al. | 381/82 |
| 5,432,858 | * | 7/1995 | Clair, Jr. et al. | 381/82 |
| 5,440,644 | | 8/1995 | Farinelli et al. | 381/81 |
| 5,740,235 | | 4/1998 | Lester et al. | 379/170 |

* cited by examiner

*Primary Examiner*—Daniel J. Wu
*Assistant Examiner*—Tai T. Nguyen
(74) *Attorney, Agent, or Firm*—Womble Carlyle Sandridge & Rice PLLC

(57) ABSTRACT

An addressable speaker system in which a plurality of selectively activated speakers are distributed throughout a predefined area and are connected to a central processing unit. The system contains multiple RF antennas that are capable of broadcasting and receiving radio frequency signals to individuals wearing radio frequency identification (RFID) badges. The system users the RF transmission to locate an intended radio frequency identification badge and selectively broadcasts an audio message to a speaker located closest to the intended recipient.

48 Claims, 7 Drawing Sheets

ADDRESSABLE SPEAKER SYSTEM

BACKGROUND OF THE INVENTION

This invention is related in general to message broadcast systems. More specifically, it is related to a system for the selective activation of individual speakers in a broadcast audio communications system.

Noise in the workplace is not a new problem, but one that is getting increased attention as work configurations and business operating models evolve. A number of recent studies indicate that noise in the form of conversational distractions is the single largest negative influence on workers' productivity. Additionally, announcement broadcasts from overhead sound systems are primary distractions, as attention is naturally drawn to these messages. This disruption in the normal workflow creates inefficiencies in people's productivity, and it degrades the overall quality of the workplace environment.

The negative effects of noise are influencing larger groups of people. As the service sector of the economy continues to grow, an increasing number of workers find themselves in office settings rather than manufacturing facilities. The need for flexible reconfigurable space has resulted in open-plan workspaces, larger rooms with reduced heights, and movable partitions over which sound can pass. The density of the office workplace is also increasing with more workers occupying a given physical space. More workers are using speakerphones along with conferencing technologies and multimedia computers with large, sound reflecting screens and voice input. All these factors have contributed to the dramatic increase in the noise level of the work place. As a result, the loudness of the paging systems and overhead sound systems has increased in order for the broadcast to be heard above the increasing ambient noise.

A major drawback of the current paging system used in most schools and businesses is the inability to confine the audio messages only to the space occupied by the intended recipient. As a simple example, consider a small business office environment having three rooms separated by partitions or walls. Each wall blocks the sound from reaching into an adjacent room. Each room is equipped with an individual speaker, which is connected to a broadcast audio power unit. Audio messages are typically maintained in a central location and sent to a broadcast power unit, which in turn drives speakers in each room. Further, consider that room 1 is empty and rooms 2 and 3 have occupants. The occupants in rooms 2 and 3 are subject to the same announcement driven by the speaker system, which is integrated into the overhead ceiling tiles, even though the announcement may only be intended for the occupants in room 2. Power used to broadcast the message into room 1 is unnecessarily wasted, since this room is unoccupied.

This mode of messaging is disruptive, inefficient, and outdated. What is needed in today's workplace environment is a message broadcast system that does not broadcast messages to all speakers simultaneously, but does drive selectively only the speaker that is nearest to the intended recipient.

SUMMARY OF THE INVENTION

The present invention provides a system and method for sending an audible message to a specifically identified individual through a selected single broadcast speaker closest to the identified individual within an environment having multiple speakers scattered throughout. A feature of the present invention is the capability to predefine the location of all broadcast speakers in a predefined area and to broadcast a message through each speaker on an individual basis. The system has the capability of locating an intended message recipient from all other personnel working within the predefined area. By combining these capabilities, a unique individual can receive an audible message from a single speaker closest to the individual without all the speakers becoming active simultaneously.

In one embodiment of the present invention, a building, such as an office or school, is equipped with a public addressing system having multiple speakers scattered throughout the building. The speakers are connected to a speaker power unit, which is also known as an audio power unit, and the public addressing system is connected to a central controller. This building is also equipped with a network of cell controllers located above the ceiling space, and each cell controller is equipped with a radio frequency communication system of transmitters, receivers, and antennas. This network of cell controllers is connected to the central controller. The central controller can be accessed by an intelligent workstation. Each person working inside the office building is given a badge equipped with an active radio frequency identification (RFID) tag. When there is an audio message to be delivered to a particular person inside the building, all cell controllers, which are mounted above the ceiling plane, will broadcast a radio frequency (RF) signal through the transmitters into the area below which includes all the rooms. When an RFID badge receives the radio frequency signal from a cell controller, the badge responds by transmitting back another RF signal that contains a unique ID code that identifies itself. This radio signal transmitted by the RFID badge is received by the nearest antennas. Each antenna may receive more than one RF signal from more than one RFID badge. Each cell controller then scans and receives the information from all the antennas that are connected to it. Upon receiving the information, each cell controller calculates the distance between each badge and the receiving antenna, and from this distance calculation, the cell controller determines the location of each tag. The location information is sent by each cell controller to the central processor which maintains a log of the location of each individual carrying an RFID badge in the building. This location log which is stored in the central processor can be accessed by the intelligent workstation when it needs to send an audio message to a particular user wearing an RFID badge.

In operation, when there is a need to broadcast an audio message to a particular user wearing an RFID badge inside the building, the receptionist, for example, identifies the person and delivers the audio message to the intelligent workstation that is connected to the central processor. The central controller, after associating the person with an RFID badge, looks in the log to determine the location of this individual and delivers the audio message by enabling the closest speaker through the speaker power unit and sending the audio message to this speaker.

DESCRIPTION OF THE DRAWINGS

The invention is better understood by reading the following detailed description of the invention in conjunction with the accompanying drawings, wherein.

DETAILED DESCRIPTION OF THE INVENTION

Figure 1:
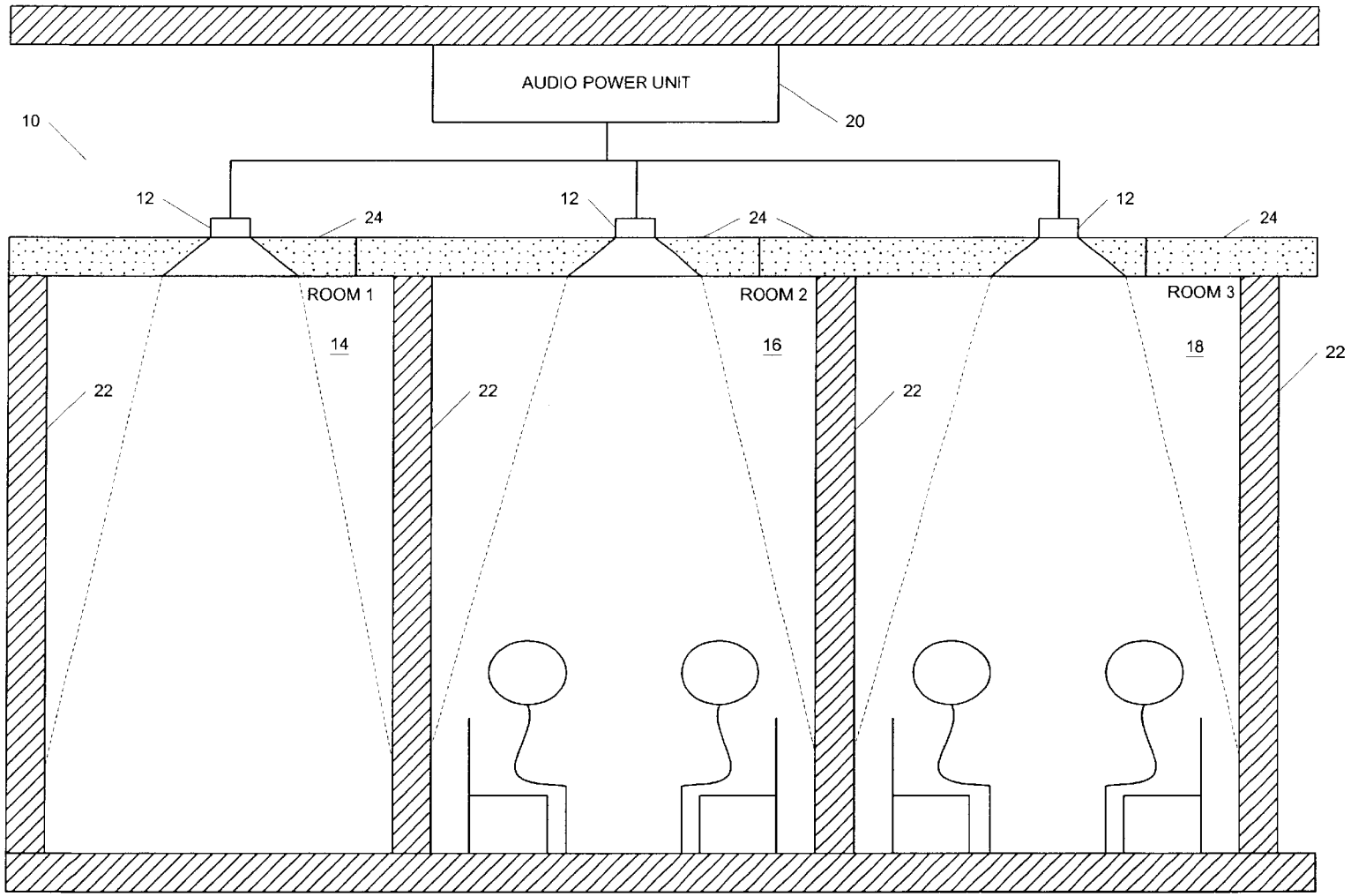
FIG. 1 PRIOR ART
FIG. 1 illustrates prior art public addressing system with multiple room speakers connected to an audio power unit.

Referring now in more detail to the drawings in which like numerals refer to like parts throughout the several figures, FIG. 1 depicts a prior art configuration of a public addressing system 10, with the speakers 12 distributed one per each room 14, 16 and 18. The speakers are interconnected to an audio power unit 20. Audio power unit 20 provides the power to drive each speaker 12. Speakers 12 are attached to, or embedded in, the ceiling tiles 24. In the example environment illustrated in FIG. 1, there are three adjacent rooms 14, 16, 18 separated by a wall 22. Each wall 22 blocks sound from reaching into an adjacent room. The figure shows that no one is present in the first room 14; two people are present in the second room 16; and two other people are present in the third room 18. When there is a need to broadcast an audio message addressed to a person in the second room 16, the audio message is broadcast through the audio power unit 20 to all the speakers 12 in the system, including the speaker 12 in the unoccupied room and the speaker 12 in the room in which unintended recipients are present.

Figure 2:
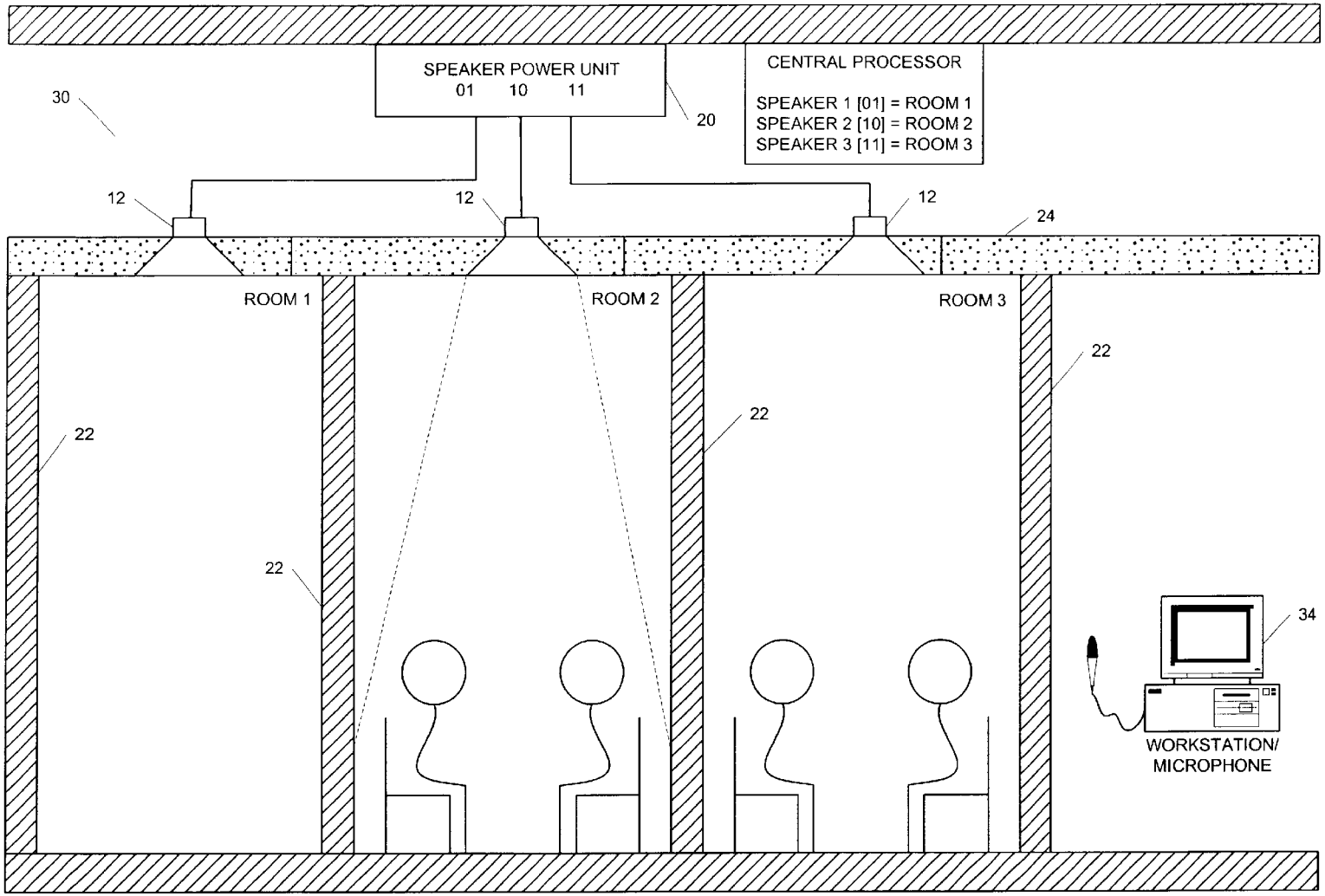
FIG. 2 illustrates an exemplary embodiment of the operation of the present invention.

FIG. 2 illustrates one embodiment of the addressable speaker system 30 of the present invention including speakers 12 interconnected to an audio power unit (speaker power unit) 20 that is connected to a central processor 32. The speakers 12 are distributed one per room and are attached to the ceiling tiles 24. The central processor 32 is further connected by means not shown to an intelligent workstation 34 that can be operated by the system administrator. The audio power unit 20 is equipped with addressable switches that are enabled and disabled by the central processor unit 32. In this description the terms "audio power unit" and "speaker power unit" are used interchangeably. The central processor 32 activates and deactivates the audio power unit 20 by sending control messages to the audio power unit 20 indicating the individual speaker 12 that is to be powered, followed by the audio message. In this way, the central processor 32 controls each speaker 12 individually. The central processor 32 receives the audio message and the identity of the audio message recipient from the intelligent workstations 34. In FIG. 2 only speaker 2 in the second room broadcasts an audible message.

Figure 3A:
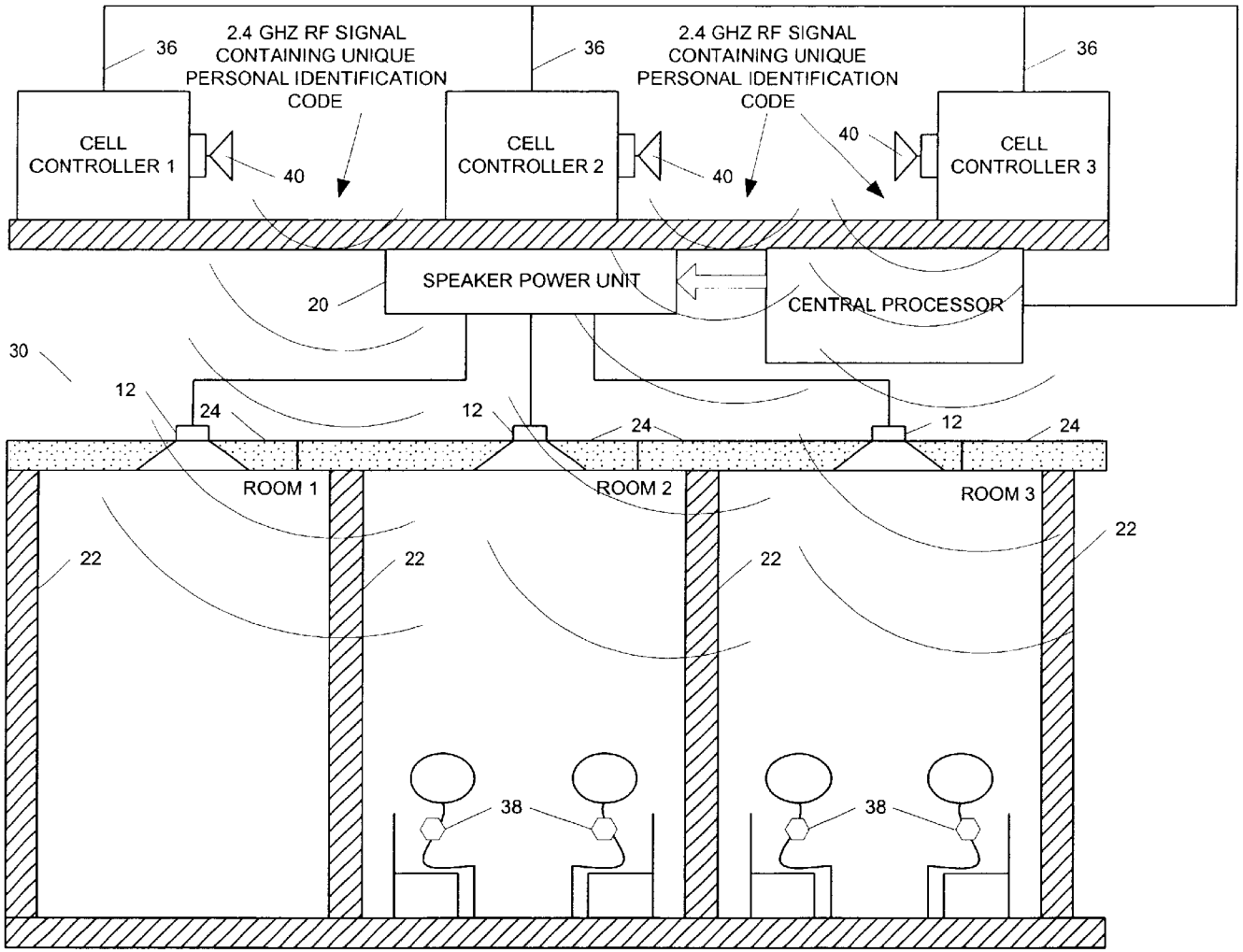
FIG. 3A illustrates a scenario in which all room antennas transmit a radio frequency (RF) signal to locate a user carrying an RFID badge.

FIG. 3A illustrates an embodiment of the addressable speaker system 30 of the present invention, that is used to locate a particular user wearing an RFID badge 38 with a unique personal identification code. The addressable speaker system 30 includes at least one cell controller 36 and a plurality of RF antennas 40 in order to determine the precise location of a user wearing an RFID badge 38. Depending on the area to be covered, the addressable speaker system 30 can have multiple cell controllers 36 covering the entire area with each cell controller 36 having several antennas 40 connected to it. Cell controllers send and receive high frequency radio signals to and from long range RF electronic tags. A typical cell controller can read tags at distances up to 250 feet without requiring line of sight. A 2.4 GHz signal is sent to any tag in the coverage area. The cell controller receives a 5.8 GHz signal back from the tag's ID. The distance of the tag from a specific antenna is calculated by the cell controller using the signal's time of flight information. By calculating the distance of the tag from several different antennas, the cell controller can instantaneously identify the location of the tag.

As illustrated in FIG. 3A, the cell controllers 36 transmit signals that are received by the RFID tags 38. The RFID tags 38 simply translate a received signal's frequency and re-transmit it back to the receiving antennas 40 with tag ID information phase-modulated onto it. The return signal is received by the cell controller 36, and the tag ID information is extracted from this signal. Each cell controller 36 determines each tag's distance from its associated antenna by measuring the round trip time of the transmitted signal.

The cell controller 36 used in the present invention is available commercially. One example of the cell controller 36 is the 3D-iD cell controller manufactured by PinPont Corporation. The cell controller 36 tracks the tag IDs from the return signals and determines for each returned signal the tag distance from the receiving antenna 40 by measuring the round trip time of the RF signal.

RFID tags 38 and their corresponding tag readers are well known to those skilled in the art. RFID tags 38 may be broadly categorized as active or passive. The basic distinction is that passive tags require no battery, so that they tend to cost less but have shorter range. As a passive RFID tag passes within range of an interrogator (i.e., a tag reader), its circuitry is charged inductively or electromagnetically. Once powered, a passive RFID tag 38 identifies itself to the interrogator using techniques such as frequency shifting, half-duplex operation, or delayed transmission. An active RFID tag 38 tends to support longer read ranges and a broader set of features. It usually operates at a higher frequency and is more expensive than a passive RFID tag. As depicted in FIG. 3A the cell controllers 36 broadcast RF signals in order to log the location of every user wearing an RFID badges 38.

Figure 3B:
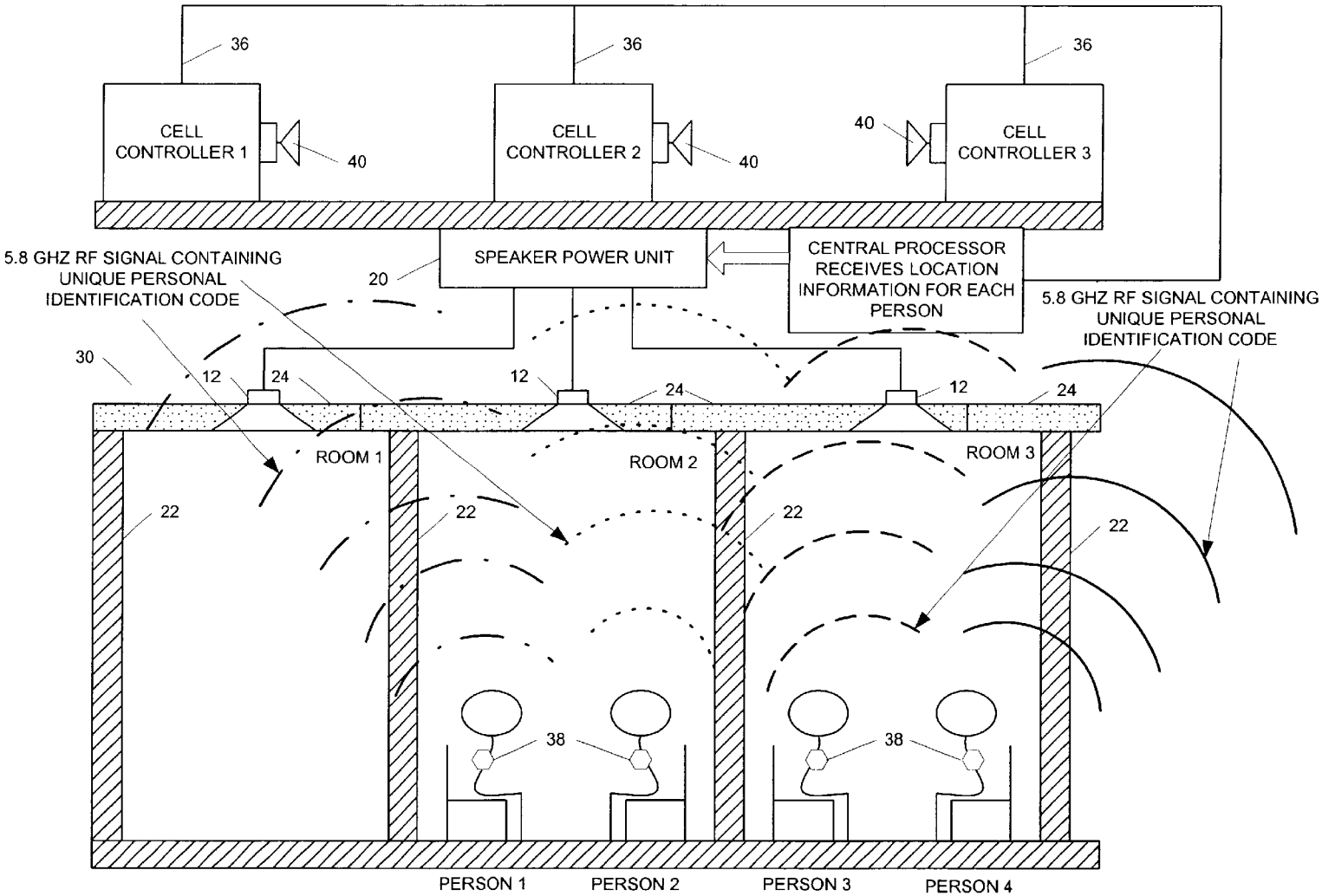
FIG. 3B illustrates a scenario in which the RFID badges transmit RF signals containing personal identification codes in response to the RF signal to locate.

FIG. 3B illustrates radio frequency signals transmitted by RFID badge 38. When each RFID badge 38 receives an RF signal from a cell controller 36, each RFID badge 38 responds by transmitting an RF signal that contains the unique ID code. The distance is calculated as a result of time synchronization with the cell controller 36. The cell controllers perform a triangulation algorithm to uniquely identify the position of each individual wearing an RFID badge 38. This location information is transmitted by the cell controller to the central processor 32 through a hard-wired connection.

With this information, the central processor 32 maintains a log of the location of each individual in the predefined area. An exemplary location log is illustrated in Table 1.

TABLE 1

| Central Processor, Location Log |
|---|
| Room 1 Unoccupied<br>Room 2 Contains Person 1, and Person 2<br>Room 3 Contains Person 3, and Person 4 |

The operator at intelligent workstation 34 (FIG. 2) is now able to send an audible message directly to any person in the specified area using the speaker 12 that is closest to that specific individual. In the configuration shown in FIG. 3B, each cell controller 36 is equipped with RF antennas 40 that captures the RF signals from each RFID badge 38.

Figure 4:
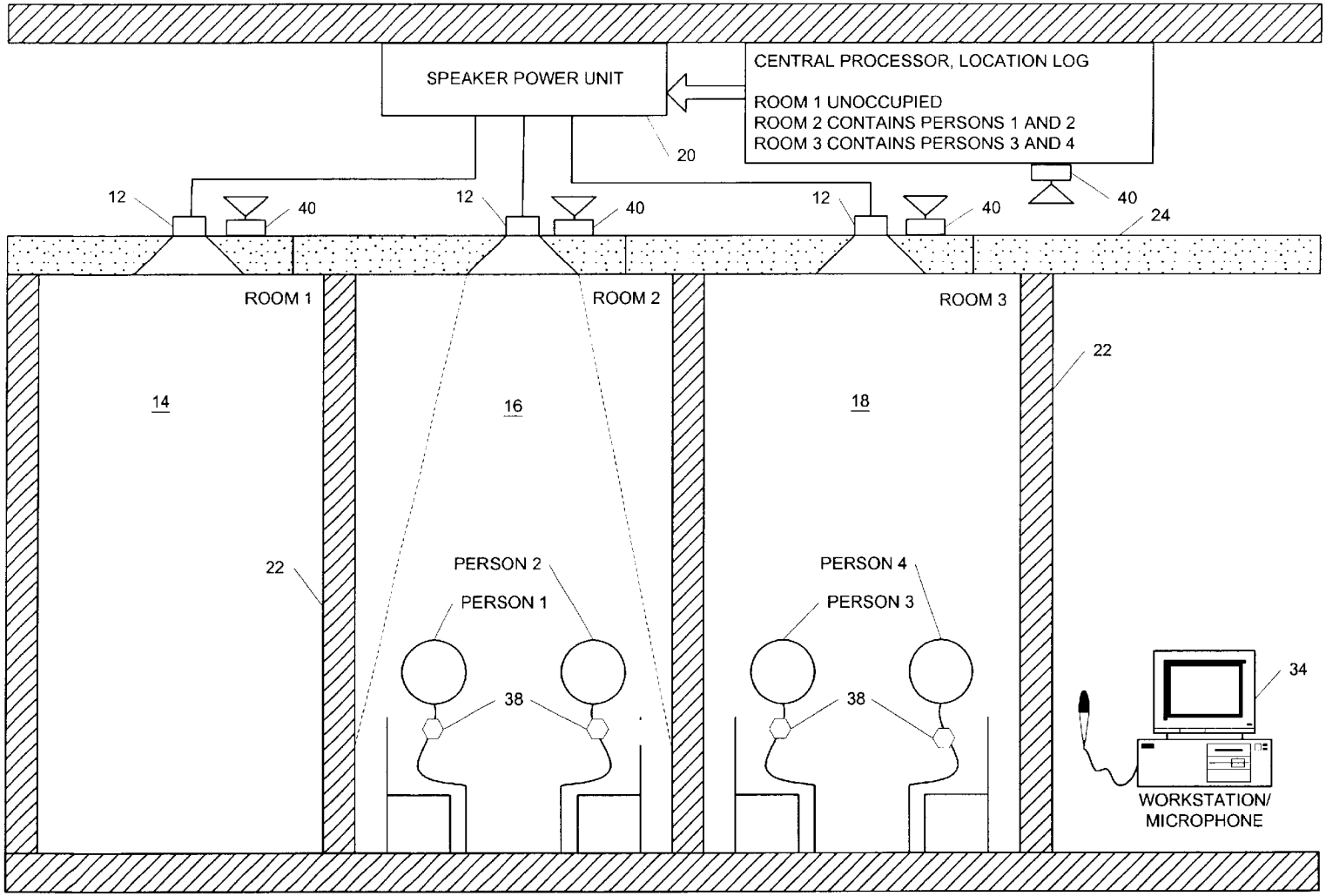
FIG. 4 illustrates the selection of one particular speaker to broadcast an audio message to a particular user.

FIG. 4 illustrates an operator at intelligent workstation 34 identifying person 1 in room 2 as the intended recipient of an audio message and sending the audio message to the intended recipient person 1. The recipient identification information and the audio message are sent to the central processor 32 where the location of the recipient is identified in the log. The central processor 32 sends a control signal to the speaker power unit 20 to power the speaker 12 closest to the intended recipient person 1. The central processor 32 routes the audio message to the selected speaker 12.

FIG. 4 also illustrates an alternative embodiment for the location of the antennas 40. In the embodiment shown, antennas 40 are located adjacent to the ceiling in each room 14, 16, 18 (the cell controllers 36 are not shown in this illustration). The antennas 40 are connected to the cell controllers 36 by means of coaxial cables. In this configuration, a less powerful receiving antenna can be used due to the proximity of each antenna 40 to the RF signal signal-emitting badges 38.

Figure 5:
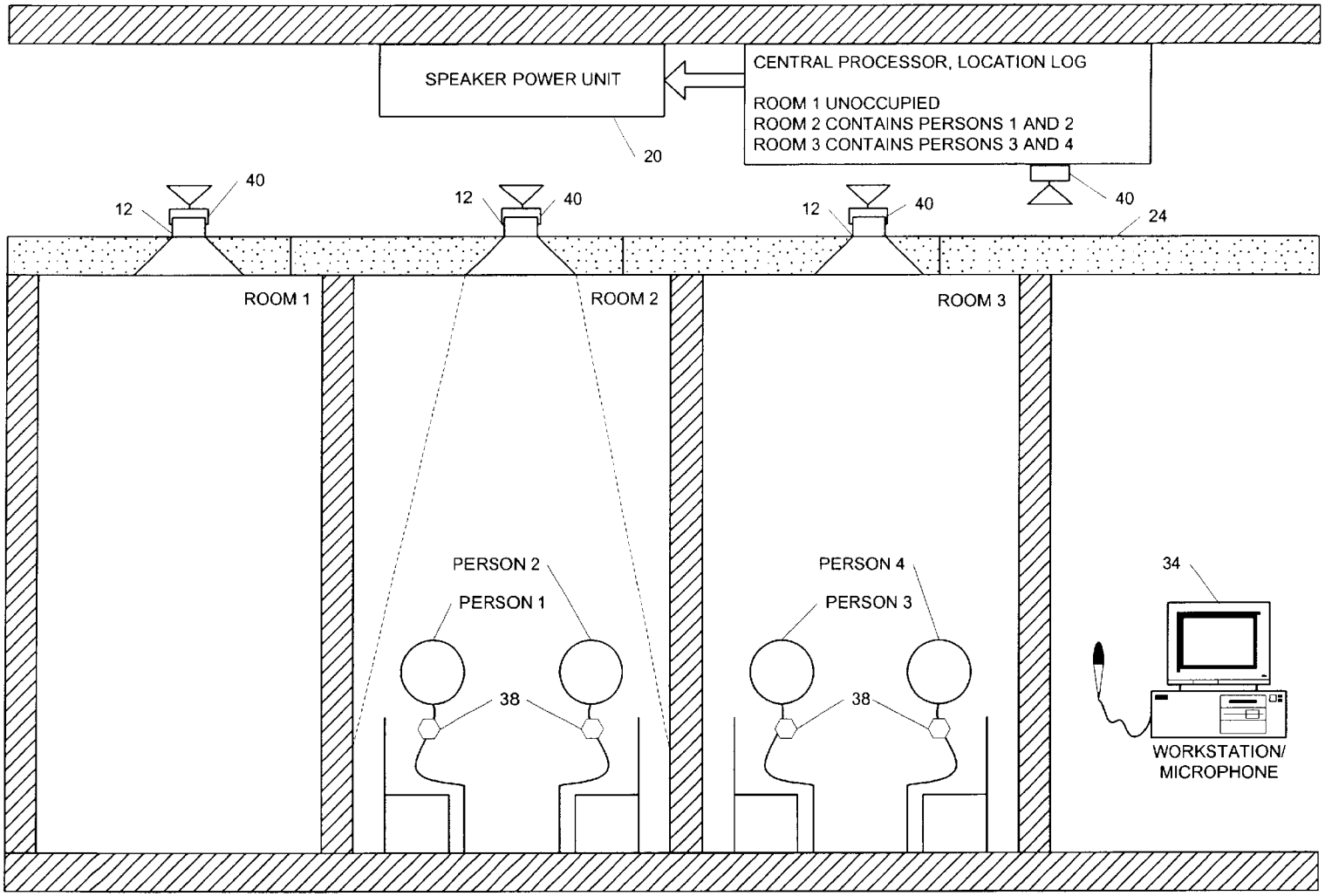
FIG. 5 illustrates an alternate embodiment employing wireless transmissions between the speaker and the speaker-powered unit.

FIG. 5 illustrates a lower cost embodiment of the present invention. In this embodiment, the speaker control system and the RF communications system are integrated. It has the added advantage of having the speakers controlled through RF commands from the central processor 32. This embodiment eliminates the need for installing separate wiring for speaker control. In this embodiment, the intelligent workstation 34 identifies the message recipient and sends an audio message and the recipient's identification to the central processor 32. The central processor 32 then selects a speaker 12 and forwards the audio message through an RF signal to the selected speaker.

Figure 6:
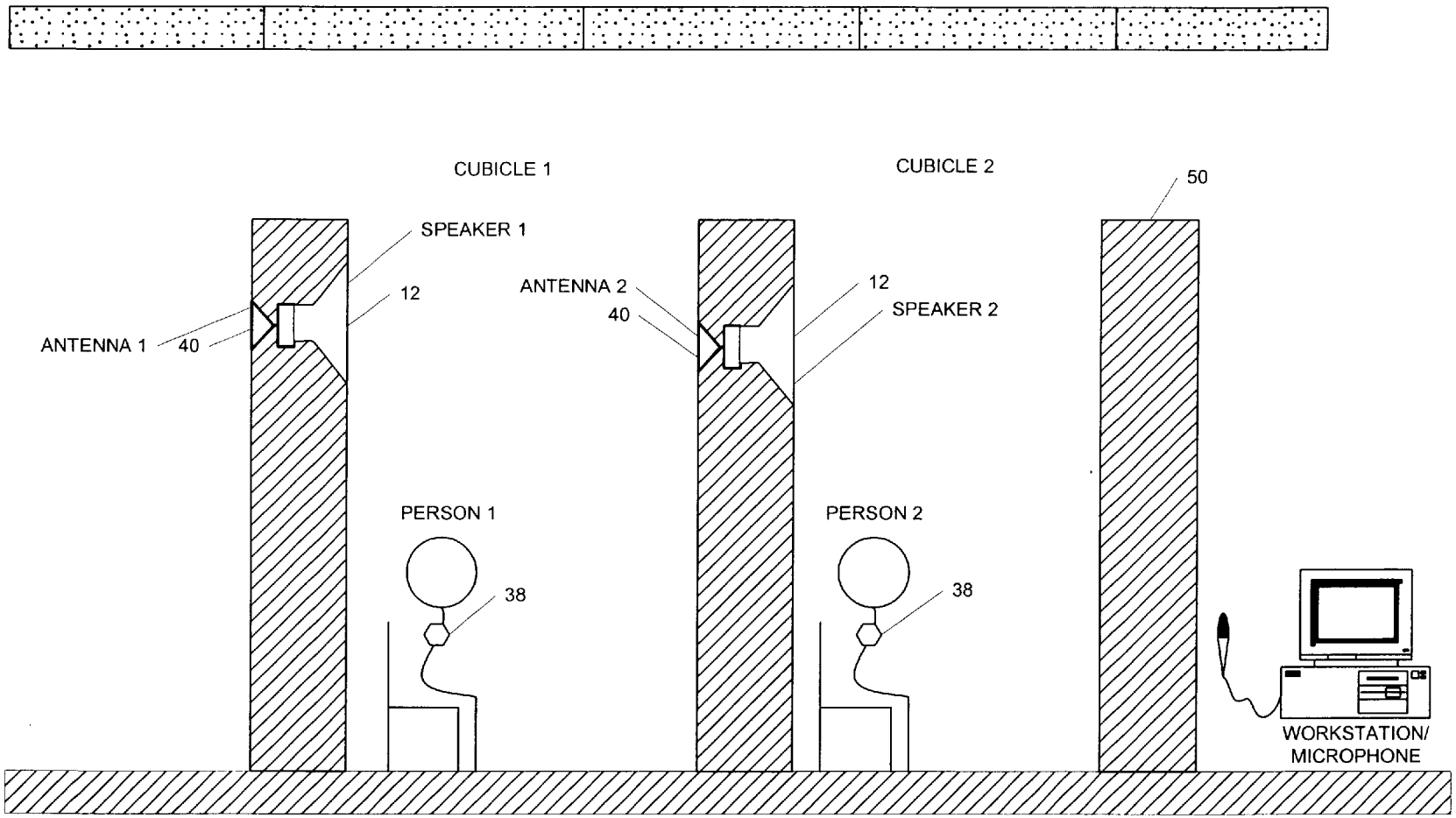
FIG. 6 illustrates another alternate embodiment in which speakers are embedded into the partition wall of a cubicle.

FIG. 6 illustrates yet another embodiment of this invention operating in an office environment having cubicle walls. Each antenna 40 and speaker 12 is embedded into a partition wall 50, and the system functions wirelessly as illustrated. By using the known position of speakers and the location of individuals within a predefined area, audible messages can be directed to the speaker closest to the individual to the exclusion of all other speakers in the broadcast system.

In another embodiment, the central processor 32 does not maintain a log of the location of every person wearing a RFID badge 38. Instead, the recipient of the audio message is located when there is an audible message to be delivered. In this embodiment, the intelligent workstation 34 sends the identity of the recipient along with the audio message to the central processor 32. The central processor 32 transmits RF signals through all the antennas 40 and reads the responses from all the RFID badges 38. Upon determining the location of the desired recipient, the central processor 32 selects the speaker 12 through the speaker power unit 20 and forwards the audio message to the selected speaker 12.

In another embodiment of the present invention, passive RFID tags are used for identification badges 38. Each room is equipped with a RFID reader that energizes the RFID tags 38 as they enter the room and reads the RFID tag's unique identification code transmitted by each RFID tag. The RFID readers are connected to the central processor 32 where a log of the locations of the RFID tags 38 are kept. In this embodiment the RFID readers in each room are active continuously, but only capture the RF signal with its unique identification code when a person wearing an RFID badge 38 enters the room.

In another embodiment, the invention enables individual remote paging to any person with access to the central processor 32, including access through an Internet connection. In this embodiment, the central controller's location broadcasting function is accessible through the Internet. A user can access the central controller's functions through a web page. The audio message and the identity of its recipient are sent to the central processor 32 through the Internet.

In summary using the known position of the speakers 12 and the location of the individual in a predefined area, audible messages can be directed selectively, according to the embodiments discussed herein, to that speaker 12 that is physically closest to the individual, to the exclusion of all other speakers 12 in the broadcast system.

Furthermore, the corresponding structures, materials, acts and equivalents of any means plus function elements in the claims below are intended to include any structure, material, or acts for performing the functions in combination with other claimed elements as specifically claimed.

While the invention has been particularly shown and described with reference to preferred embodiments thereof, it will be understood by those skilled in the art that various other changes in form and detail may be made without departing from the spirit and scope of the invention.

What is claimed is:

1. An addressable speaker system comprising:

a plurality of addressable speakers located throughout a predefined area;

a central processor including a computer memory for storing binary address information that identifies each addressable speaker and a corresponding location in the predefined area;

a speaker power unit connected to the central processor and the plurality of addressable speakers, the speaker power unit including addressable switches that are enabled and disabled by the central processor; and an intelligent workstation for indicating a specific addressable speaker that is to be powered to broadcast an audible message to the corresponding location.

2. The addressable speaker system of claim 1 wherein the plurality of speakers are attached to ceiling tiles.

3. The addressable speaker system of claim 1 wherein the plurality of addressable speakers are embedded in the ceiling tiles.

4. The addressable speaker system of claim 1 further comprising a microphone wherein the microphone and the intelligent workstation are connected to the central processor.

5. The addressable speaker system of claim 1 wherein the plurality of addressable speakers are located above a ceiling plane.

6. The addressable speaker system of claim 1 wherein the speakers are embedded in a partition wall of each corresponding location.

7. An addressable speaker system comprising:

a plurality of addressable speakers located throughout a predefined area;

a central processor including a computer memory for storing a location log;

a speaker power unit connected to the central processor and the plurality of addressable speakers, the speaker power unit including addressable switches that are enabled and disabled by the central processor;

a plurality of cell controllers connected to the central processor and mounted above the predefined area for transmitting a radio frequency (RF) signal into the predefined area; and a plurality of radio frequency identification (RFID) tags that are in communication with a transmitter and a receiver of each cell controller.

8. The addressable speaker system of claim 7 wherein the plurality of addressable speakers are attached to ceiling tiles.

9. The addressable speaker system of claim 7 wherein the plurality of addressable speakers are embedded in the ceiling tiles.

10. The addressable speaker system of claim 7 wherein the plurality of addressable speakers are located above a ceiling plane.

11. The addressable speaker system of claim 7 wherein the plurality of radio frequency identification tags are active tags.

12. The addressable speaker system of claim 11 wherein the plurality of radio frequency identification tags each include a unique identification code.

13. The addressable speaker system of claim 11 wherein each of the plurality of radio frequency identification tags further comprises:

a radio frequency signal transmitter; and a radio frequency signal receiver.

14. The addressable speaker system of claim 7 wherein the plurality of radio frequency identification tags are passive tags.

15. The addressable speaker system of claim 7 further comprising a location log for identifying the location of each radio frequency identification tag, the location log being stored at the central processor.

16. The addressable speaker system of claim 7 wherein the central processor sends messages to and receives messages from a global communications network.

17. An addressable speaker system comprising:

a plurality of addressable speakers located throughout a predefined area;

a plurality of transmitter/receiver devices co-located and integrated with the plurality of addressable speakers;

a plurality of radio frequency identification tags in communication with the transmitter/receiver devices; and a speaker power unit connected to the central processor, the speaker power unit including addressable switches that are enabled and disabled by the central processor.

18. The addressable speaker system of claim 17 wherein the speaker power unit communicates wirelessly with the plurality of addressable speakers and the plurality of integrated transmitter/receiver devices.

19. The addressable speaker system of claim 17 further comprising an intelligent workstation for indicating a specific addressable speaker that is to be powered to broadcast an audible message to a corresponding room location.

20. The addressable speaker system of claim 17 wherein the plurality of addressable speakers are controlled through radio frequency commands from the central processor.

21. The addressable speaker system of claim 17 wherein the plurality of addressable speakers are attached to ceiling tiles.

22. The addressable speaker system of claim 17 wherein the plurality of addressable speakers are embedded in ceiling tiles.

23. The addressable speaker system of claim 17 wherein the plurality of addressable speakers and plurality of transmitter/receiver devices are located above the ceiling plane.

24. The addressable speaker system of claim 17 wherein each of the plurality of transmitter/receiver devices includes one or more of a radio frequency antenna, a radio frequency transmitter, and a radio frequency receiver.

25. The addressable speaker system of claim 17 wherein the plurality of addressable speakers and the plurality of transmitter/receiver devices are located in a plurality of partition walls that divide the predefined area into separately enclosed rooms.

26. The addressable speaker system of claim 17 wherein said plurality of radio frequency identification tags each includes a unique identification code, a radio frequency signal transmitter, and a radio frequency signal receiver.

27. A method for selectively activating an addressable speaker in an audio broadcast messaging system including a plurality of addressable speakers, a central processor, a speaker power unit and an intelligent workstation for indicating the addressable speaker to be activated, comprising the acts of:

locating the plurality of addressable speakers throughout a predefined area;

storing a table of binary address information that identifies each addressable speaker and a corresponding location within the predefined area;

indicating to the central processor a specific addressable speaker that is to be powered to broadcast an audible message into the corresponding location; and enabling an addressable switch in the speaker power unit to activate the specific addressable speaker.

28. The method for selectively activating an addressable speaker of claim 27 further comprising:

retrieving the binary address information that identifies the specific addressable speaker; and providing the binary address information identifying the specific addressable speaker to the speaker power unit.

29. The method for selectively activating an addressable speaker of claim 27 wherein the plurality of addressable speakers, the speaker power unit and the central processor are located above the ceiling plane.

30. A method for selectively activating an addressable speaker in an audio broadcast messaging system including a plurality of addressable speakers, a central processor, a speaker power unit, a plurality of cell controllers and a plurality of radio frequency identification (RFID) tags, comprising the acts of:

locating the plurality of speakers throughout a predefined area;

transmitting a radio frequency signal into the predefined area by each cell controller;

receiving the transmitted radio frequency signals by each radio frequency identification tag;

in response to the received radio frequency signals, transmitting a radio frequency signal from each radio frequency identification tag to the plurality of cell controllers;

determining the location within the predefined area of each radio frequency identification tag; and enabling an addressable switch in the speaker power unit to activate a specific addressable speaker.

31. The method for selectively activating an addressable speaker of claim 30 further comprising maintaining a log of the location of each radio frequency identification tag within the predefined area.

32. The method for selectively activating an addressable speaker of claim 30 wherein the radio frequency signal transmitted from each radio frequency identification tag includes a unique identification code and the distance of the badge from the cell controller.

33. The method for selectively activating an addressable speaker of claim 32 wherein the distance is calculated as a result of time synchronization with the cell controller.

34. The method for selectively activating an addressable speaker of claim 30 wherein the step of determining the location within the predefined area of each radio frequency identification tag is based on a triangulation algorithm performed by the plurality of cell controllers.

35. The method for selectively activating an addressable speaker of claim 30 wherein the plurality of addressable speakers, the central processor, the speaker power unit, and the plurality of cell controllers are located above the ceiling plane.

36. A method for selectively activating an addressable speaker in an audio broadcast messaging system, including a plurality of addressable speakers, a central processor, a speaker power unit, a plurality of transmitter/receiver devices co-located and integrated with the plurality of addressable speakers, and a plurality of radio frequency identification (RFID) tags, comprising the acts of:

locating the plurality of speakers throughout a predefined area;

transmitting a radio frequency signal into the predefined area by each of the plurality of transmitter/receiver devices;

receiving the transmitted radio frequency signals by each radio frequency identification tag;

in response to the received radio frequency signals, transmitting a radio frequency signal from each radio frequency identification tag to the plurality of transmitter/receiver devices;

determining the location within the predefined area of each radio frequency identification tag; and enabling an addressable switch in a speaker power unit to activate a specific addressable speaker.

37. The method for selectively activating an addressable speaker of claim 36 further comprising maintaining a log of the location of each radio frequency identification tag within the predefined area.

38. The method for selectively activating an addressable speaker of claim 36 wherein the radio frequency signal transmitted from each radio frequency identification tag includes a unique identification code and a distance of the badge from the transmitter/receiver.

39. The method for selectively activating an addressable speaker of claim 36 wherein the step of determining the location within the predefined area of each radio frequency identification tag is based on a triangulation algorithm performed by the central processor.

40. The method for selectively activating an addressable speaker of claim 36 wherein the plurality of addressable speakers, the central processor, the speaker power unit, and the plurality of transmitter/receiver devices are located above the ceiling plane.

41. The method for selectively activating an addressable speaker of claim 36 wherein the speaker power unit communicates wirelessly with the transmitter/receiver devices.

42. A method for directing an audio page to a selected individual within a predefined area comprising the steps of determining a location of the individual within the predefined area and broadcasting the audio page in the vicinity of the determined location wherein the step of broadcasting the audio page in the vicinity of the determined location comprises selecting a loudspeaker located in the vicinity of the determined location and activating the selected loudspeaker to produce the audio page.

43. A method for directing an audio page to a selected individual within a predefined area comprising the steps of determining a location of the individual within the predefined area and broadcasting the audio page in the vicinity of the determined location wherein the step of determining the location of the individual within the predefined area comprises the acts of equipping the individual with a readable identification tag bearing a code identifying the individual, receiving the code from the identification tag, and determining the location of the identification tag and the location of the individual based on the received code.

44. The method for directing an audio page to a selected individual of claim 43 wherein the readable identification tag is a Radio Frequency Identification (RFID) tag capable of transmitting the code via a radio frequency transmission.

45. The method for directing an audio page to a selected individual of claim 44 wherein the RFID tag is activated to transmit its code upon receipt of a radio frequency polling signal and wherein the step of receiving the code from the identification tag comprises transmitting a polling signal into the predefined area to activate the identification tag and receiving the identifying code via radio frequency transmission from the identification tag.

46. The method for directing an audio page to a selected individual of claim 43 further comprising the step of receiving the code at a plurality of receiving locations within the predefined area and wherein the act of determining the location of the identification tag comprises analyzing the receipt of the code at the plurality of locations to pinpoint the location of the identification tag.

47. The method for directing an audio page to a selected individual of claim 46 wherein the readable identification tag is a Radio Frequency Identification (RFID) tag and wherein the step of receiving the code at a plurality of locations comprises transmitting a radio frequency polling signal from each of the locations to cause the RFID tag to transmit its identifying code via a return radio frequency transmission, and wherein the step of analyzing the receipt of the code at the plurality of locations comprises determining the distance between each location and the identification tag based on the round trip time of the radio frequency signals and applying a triangulation algorithm to the determined distances to pinpoint the location of the identification tag.

48. The method for directing an audio page to a selected individual of claim 47 wherein the step of broadcasting the audio page in the vicinity of the determined location comprises selecting a loudspeaker in the vicinity of the determined location and directing a signal to the selected loudspeaker causing it to broadcast the audio page.

* * * * *